US005170888A

United States Patent [19]

Goncalves

[11] Patent Number: 5,170,888

[45] Date of Patent: Dec. 15, 1992

[54] DEVICE FOR KEEPING AT LEAST TWO PRODUCTS SEPARATE FROM EACH OTHER AND FOR ENABLING THEIR MIXING AT THE TIME OF ITS USE

[75] Inventor: Antonin Goncalves, Montmorency, France

[73] Assignee: L'Oreal, Paris, France

[21] Appl. No.: 729,440

[22] Filed: Jul. 12, 1991

[30] Foreign Application Priority Data

Sep. 5, 1990 [FR] France ..... 90 11010

[51] Int. Cl.[5] ..... B65D 25/08

[52] U.S. Cl. ..... 206/222

[58] Field of Search ..... 206/219, 222, 221

[56] References Cited

U.S. PATENT DOCUMENTS 4,693,366 9/1987 Goncalves ..... 206/222
4,757,916 7/1988 Goncalves ..... 206/222 X
4,986,322 1/1991 Chibret et al. ..... 206/219 X

FOREIGN PATENT DOCUMENTS 0293290 11/1988 European Pat. Off. .
0333541 9/1989 European Pat. Off. .
2569666 3/1986 Japan .

*Primary Examiner*—William I. Price
*Attorney, Agent, or Firm*—Cushman, Darby & Cushman

[57] ABSTRACT

The device relates to a container (1) of glass defining a first compartment for one (A) of the products and is provided with a neck (2), a bottle (16) mounted on the neck defining another compartment intended to receive the other product (B), means of separation of the two compartments comprising at least one membrane (7, 7a) and a perforator assembly (18) and means for displacing the perforating unit. An intermediate coupling (11) of non-polluting plastics material is fixed on the neck (2) of the container and forms an annular housing (12), opening to the side opposite the bottom of the container (1); the perforating assembly (18) is rigid with the bottle (16). A projecting skirt (25), rigid with the end of the bottle, is provided to remain engaged, in a sealing manner, in the said annular housing (12) while being able to slide, when there is relative displacement of the bottle (16) and the container necessary for perforation.

8 Claims, 2 Drawing Sheets

DEVICE FOR KEEPING AT LEAST TWO PRODUCTS SEPARATE FROM EACH OTHER AND FOR ENABLING THEIR MIXING AT THE TIME OF ITS USE

The invention relates to a device for keeping separate from at least two products and for enabling their mixing at the time of its use comprising: a container provided with a neck defining a first compartment for one of the products; a bottle mounted on the neck and defining another compartment intended to bold another product; separation means between the two compartments comprising at least a membrane; a perforating assembly which can be displaced at least along the axial direction of the container in a manner as to tear the membrane at the time when it is desired to mix the products; and means to displace the perforating assembly.

The invention more particularly, but not exclusively, concerns such a device for holding the colorant and the oxidant of a shampoo coloring because it is in this case that the application presents the greatest interest;

A device of this type is shown in FR-A-2569666, in the name of the same applicant. Such a device has been experimented with success but the compartment containing the coloring is provided with an element of PVC-type plastic material whose disposal after use presents pollution problems.

The object of the present invention is present, above all, to provide a device of the kind previously defined which, having all the advantages of functionality and use of the previous devices, (in particular maintaining a seal between the container and the bottle until the mixing is effected), no longer presents the inconvenience of constituent elements which can create a pollution problem upon disposal.

According to the invention, a device for keeping separate at least two products is characterized in that the container is of glass and, in the case of a shampoo coloring, is intended to hold the colorant. An intermediate coupling of non-polluting plastic material is fixed on the neck of the container and presents an annular housing with a U-shaped cross-section opening opposite to the bottom of the container. The perforating assembly is fixed to the bottle. A protruding skirt, fixed to the part of the bottle turned towards the container, is arranged to stay engaged in an sealed manner, with the annular housing of the coupling completely slidable until the movement of relative rotary displacement of the bottle and the container necessary for perforation.

Advantageously, the exterior wall of the intermediate coupling is provided with connection means, (in particular a screw thread), whereas uniting means rigid with the bottle is provided to cooperate with that of the coupling and allow translatory displacement of the perforating member, relative to the container, as a result of a rotary movement.

The neck of the container has an annular skirt fixed tightly thereto, in particular by screwing onto collar which is arranged on a separating means, in particular constituted by at least one membrane held between the skirt and the shoulder of the intermediate coupling clipped onto skirt.

The separation membrane may be sealed on the collar and another membrane sealed on the shoulder of the intermediate sleeve, such that the two membranes are pressed against one another at the time of assembly of the bottle and container.

When the membranes are of aluminum with a non-varnished periphery, the periphery situated on the bottle (oxidant) side is protected to avoid all chemical effects.

The perforating assembly consists, preferably, of a perforation unit separate from the bottle and fixedly arranged on the lower part of the bottle, in particular by clipping.

The peripheral skirt is advantageously provided in the perforating assembly, around the perforator itself, and presents a U-shape in cross-section its concavity turned towards the side opposite the intermediate coupling. This skirt secures the join between the external cylindrical sleeve and the internal concentric sleeve, at the lower end of which is fixed the perforator which is offset with regard to the assembly.

The internal sleeve includes longitudinal openings and, at its lower end, a projection turned radially towards the exterior, constituting a kind of lip,, whilst the intermediate coupling includes, on its inner wall, a projection turned radially towards the interior similarly forming a kind of lip arranged to cooperate with that of the internal sleeve of the assembly to prevent an axial separation of the two elements.

The perforator may be constructed from a tubular element having a bevelled end arranged to open and fold back in a progressive manner the membrane in a large as diameter as possible, at the time of rotation.

The bottle is provided with, at its end opposite the container, a nozzle applicator, and a cap to cover the bottle.

The cap may be of oval shape, and its self-alignment on the bottle may be accomplished by to teeth, in particular very small teeth, provided between a part of the cap and the nozzle applicator.

The invention consists, in addition to the features described hereinabove, a certain number of other arrangements which will be discussed in more detail with reference to the accompanying diagrams, but which are in no way limiting.

FIG. 1, of the drawings, is a side view of a device according to the invention, at the moment when a guarantee band is torn during use.

Figure 5:
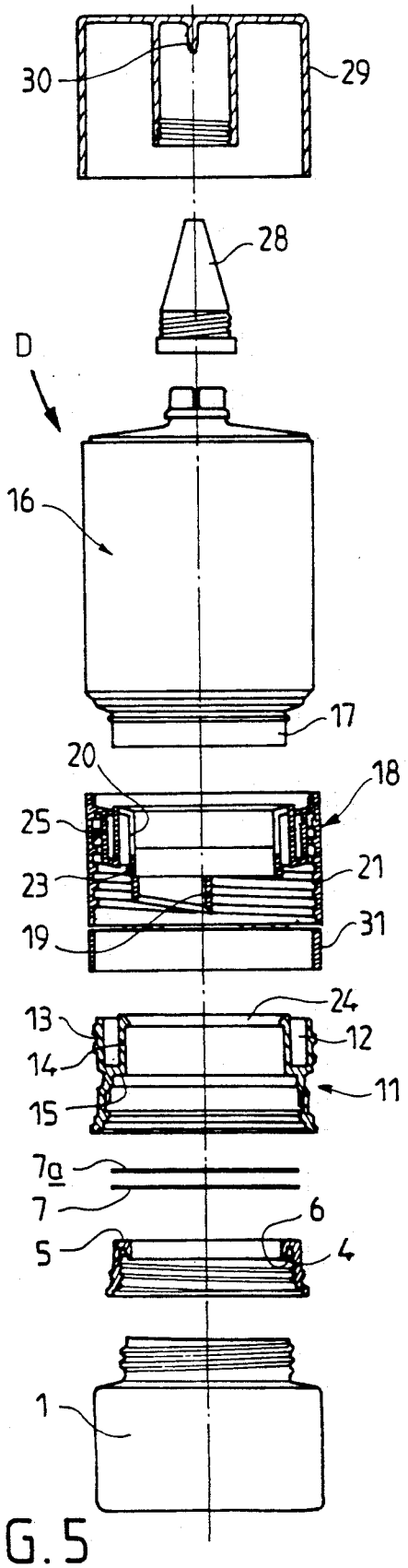

FIG. 5, finally, is a vertical exploded section with external parts, on a smaller scale, of the device according to the invention.

Figure 1:
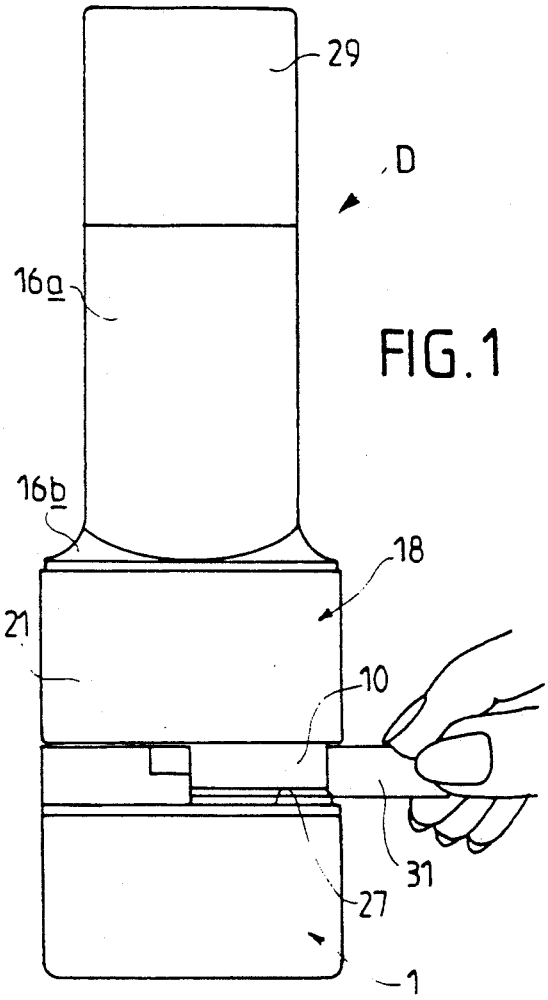
Figure 3:
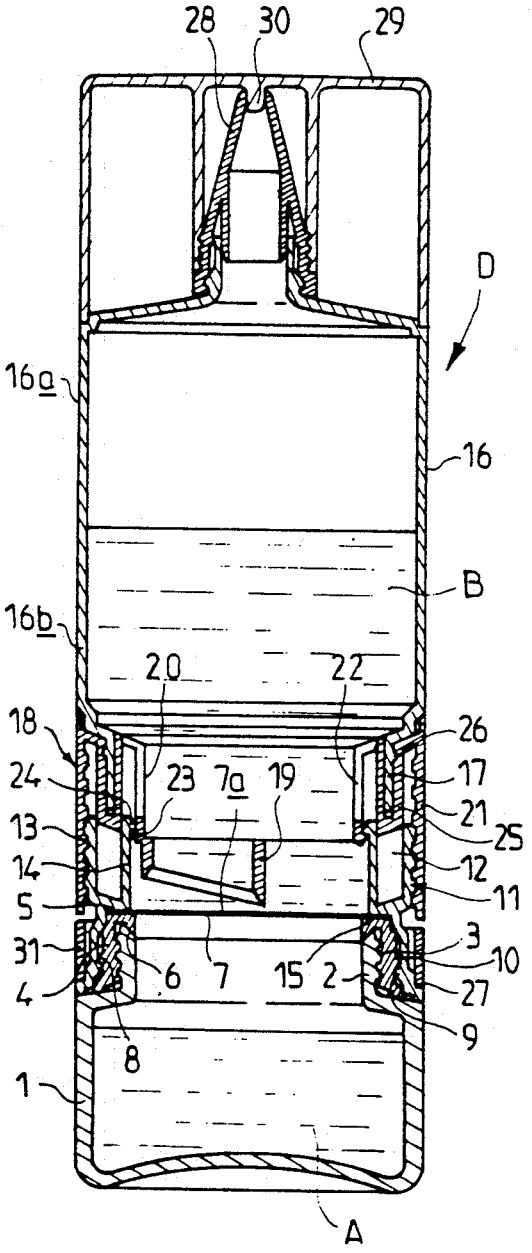
FIG. 3 is a vertical section, along the line III—III of FIG. 2, on a larger scale, of the device when the container and bottle occupy their relative positions in storage.

Referring to the drawings, in particular FIGS. 1 and 3, there is shown a device D for keeping separate from each other two products A and B. In particular, the device D is intended to contain the compositions of a shampoo coloring, the product A being the colorant whilst the product B is the oxidant.

The device D comprises a container 1 situated at the lower part defining a first compartment for the product A, more active from a chemical view than the product B. This container 1 is made from glass with good resistance to the product A, without creating pollution problems when there is the question of disposal of the container after use. This container 1 forms a kind of cylindrical pot provided with, at its upper end, a neck 2 of smaller diameter having, on its exterior surface, screw thread connection means 3. The neck 2 is equipped on its exterior with a collar 4 of plastic material, especially polyethylene, fixed by screwing. The said collar includes on its inner cylindrical surface a screw thread mating with the screw thread 3 of the neck. The upper edge 5 of the collar 4 is situated in a plane orthogonal to the axis of the collar and overlaps the upper edge of the neck 2. The edge 5 is provided, on its interior contour, with a truncated cone sealing skirt 6 which acts against a widening join of the neck 2.

A means of separation or closure is fixed to the upper edge 5 of the collar. It is usually a membrane 7, for example of aluminum, thermosealed on this edge 5 in a manner so that the product A would be enclosed in a sealed manner in the container 1.

The exterior cylindrical surface of the collar 4 comprises a ratchet bead 8 forming a circular ridge protruding towards the exterior, beneath which clips a bead 9 protruding towards the interior is provided on the internal surface of the wall 10 of an intermediate coupling 11. This intermediate coupling 11 is made from a non-polluting plastics material, of the same as collar 4, in particular from polyethylene. The coupling 11 has an annular seating 12 of U-shaped cross-section, opening on the side opposite the bottom of container 1.

The seating 12 is defined by two cylindrical coaxial walls 13, 14, respectively exterior and interior. The wall 14 is radially offset in relation to the wall 10 such that a radial shoulder is formed at the junction of the upper end of the wall 10 and the bottom of the seating 12. Another means of separation is fixed against this radial shoulder 15, in plane orthogonal to the axis of the coupling 11; this means of separation is similarly formed from a membrane *7a*, for example from aluminum, thermosealed onto the shoulder 15. The coupling 11 is fixed on the neck 2 of the container 1 by ratcheting of the bead 9 behind the bead 8, the shoulder 15 thus being supported against the upper edge 5 trapping the peripheral edges of the membranes 7,*7a* on top of each other.

Figure 2:
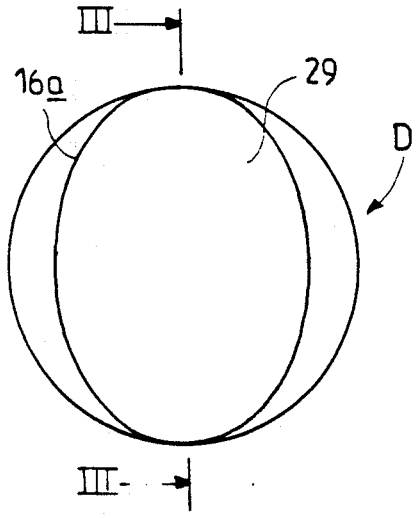
FIG. 2 is a plan view of FIG. 1.

The product B, the oxidant in the example of the shampoo coloring, is contained in a bottle 16, of non-polluting plastics material, for example of polyethylene, mounted on the neck 2 of the container The upper part 16*a* of the bottle 2 may be oval, as shown in FIG. 2, joining the continuation of the cylindrical contour of the container 1, the lower part 16*b* of the bottle 2 being of cylindrical form to allow fixing of the bottle to the neck 2. The lower part of the bottle 16 is open and defined by a cylindrical neck 17 of reduced diameter.

The non-varnished periphery of the membrane situated on the side of the bottle 16 (oxidant) is protected to avoid all chemical effects.

A perforating assembly 18, consisting of a member separate from the bottle 16, is fixed to the lower part of this bottle, on the neck 17. The perforating assembly 18, advantageously made of a copolymer, includes a perforator appropriately called 19 consisting of a tubular element of lower bevelled edge, facing towards the membranes *7a*, 7. The perforator 19 is situated radially at the interior of the cylindrical wall 14 and is off-center with regard to the common axis of the container 1 and the bottle 16.

The external diameter of the perforator 19 is approximately equal to the internal radius of the neck 2, and the contour of the perforator is approximately tangential to the continuation of the internal cylindrical surface of the neck 2.

The perforator 19 is supported by an internal sleeve 20 coaxial with the container 1 and is part of the assembly 18, which comprises an external cylindrical sleeve 21 having interiorly a screw thread suitable for cooperating with a similar screw thread provided on the exterior of the wall 13 of the coupling 11, in such a way that relative rotation of the sleeve 21 and the coupling 11 produces a translational displacement of the sleeve 21 relative to this coupling.

The internal sleeve 20 has, in its wall, longitudinal openings 22 and, at its lower end, a protrusion 23 formed radially towards to exterior, forming a kind of spear. The internal wall 14 of the intermediate coupling 11 has, at its upper end, protrusion 24 formed radially towards the interior forming similarly a kind of arranged to cooperate with that 23 of the perforation assembly 18, to prevent the axial separation of the coupling and the assembly 18 by unscrewing.

The internal sleeve 20 and the external sleeve 21 are connected by a part 25 of generally U-shaped cross-section with its concave side turned towards the coupling 11. This part 25 is arranged to receive, in the concavity, the cylindrical neck 17 which is provided, towards its base, with a ratchet bead 26 arranged to cooperate with a corresponding throat, provided in part 25, for rigidifying the assembly of the perforator 18 and the bottle 16. The U-shaped part 25 consists of a peripheral skirt, rigid with neck 17 and bottle 16, arranged to slide in a sealing manner in the housing 12 of the intermediate coupling 11.

In the storage position of the device D (FIG. 3), the lower end of the part 25 remains engaged in the housing 12, but is situated towards the upper end of the housing. In the usage position (FIG. 4), the skirt 25 is driven into the housing 12 and its lower end is situated in the vicinity of the bottom of this housing.

The sleeve 21 of the perforating assembly is provided, at its lower part, with a guarantee band 31 which is supported, in the storage position, against a shoulder 27 situated at the base of the wall 10. The guarantee band 31 is only connected to the sleeve 21 at certain zones, which are precut and facilitate the tearing of this band 31, the tearing being necessary to allow the screwing of the sleeve 21 onto the coupling and the displacing of the perforator 19 to tear the membranes 7, *7a*.

The bottle 16 is provided, at its end opposite the container 1, with a neck having an applicator nozzle 28, of for example polyethylene. The bottle 16 is closed by a cap 29, for example of polypropylene, carrying at the center a nipple 30 for closing a sealing manner the nozzle 28. The self-aligning of the cap on the bottle may be attained by teeth, in particular very small, between the cap and the applicator nozzle.

Thus the packaging of the products and the use of the device is as follows.

After filling the coloring A in the glass container, there is screwed onto the neck 2 the collar 4 and the intermediate coupling 11 ratcheted on the said collar; The aluminum membranes 7, *7a* are put in place and establish a separation at the level of the surface of support edge 5 and the shoulder 15.

The perforator assembly 18 is fixed by ratcheting onto the lower neck of the bottle 16. This assembly then screwed onto the intermediate sleeve 11 by cooperation of the internal thread of the sleeve 21 and the external thread of the wall 13, until the lower edge of the guarantee band 31 comes against the shoulder 27. In this position, the lip 24, extends past lip 23 (see FIG. 3) and there is a coupling between the coupling Il and the perforating assembly 18. The bottle 16 may now no longer be separated by normal unscrewing. The perforator 19 remains apart from the membranes 7, 7*a*.

One then proceeds to fill product B (oxidant) in the bottle 16 is then arrange the clipping of the cap assembly 29 and the nozzle, 28 on the upper neck of the bottle 16.

The packaging is thus finished and the device D may be stored, with the two products separated, ready for use.

It is to be noted that the aluminum membranes 7, 7*a* are sealed to two different members that is the collar 4 and the intermediate coupling 11 and are tested separately before assembly, thus constituting a reliability for the formation of the separation seal, thus creating two successive barriers. Nevertheless, a single membrane may be sufficient.

When it is desired to effect the mixing of the products, one begins with the tearing of the guarantee band 31, as shown in FIG. 1, to release a free annular space between the lower part of sleeve 21 and the shoulder 27, and to allow the screwing of this sleeve 21.

One can thus turn, relative to container 1, the sleeve assembly 21, the bottle 16 and the perforator 19.

This results in an axial displacement of the bottle 16 and the perforator 19 in a direction of the membranes 7 and 7*a* and a rotary movement of the perforator 19 which is offset.

The membranes 7 and 7*a* are progressively cut on virtually all of their surface thanks to the double translatory and rotary movement of the perforator.

Figure 4:
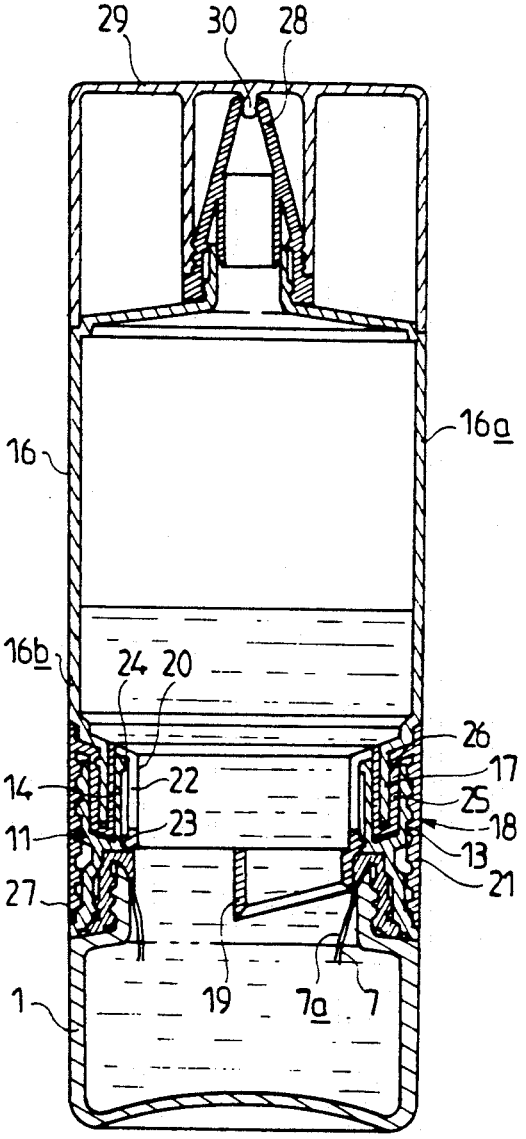
FIG. 4 represents, in a like manner to FIG. 3, the device in position of use, the perforator having torn the means of separation between the container and the bottle.

At the end of the screwing, the relative positions of the bottle 16, the perforator 19 and the container 1 are shown in FIG. 4, The oxidant B contained in bottle 16 falls into the coloring A contained in the container 1. The mixture is well achieved taking into account the perforation diameter ensure by the perforator 19.

In use, the relatively thick product in the glass container is dispensed as soon as one exerts pressure or presses on the bottle 16 made of plastics material.

I claim:

1. A device for keeping separate at least two products, in particular the coloring and the oxidant for shampoo coloring, and for the mixing of these products at the moment of use, comprising:

a container (1) defining a first compartment for one of the products and provided with a neck (2);

a bottle (16) mounted on the neck and defining another compartment intended to hold another product;

separating means between the compartments comprising a membrane means (7, 7*a*);

a perforating assembly (18) arranged to be displaced at least along the axial direction of the container to tear the membrane at the moment when it is required to mix the products; and means for displacing the perforating assembly characterized in that:

the container (1) is of glass and, in the case of a shampoo coloring, is intended to hold the colorant; an intermediate coupling (11), of non-polluting plastics material, is fixed on the neck (2) of the container and presents an annular seat (12) which opens to the side opposite the bottom of the container; the perforating assembly (18) is rigid with the bottle (16); and a projecting skirt (25), rigid at the end of the bottle (16) turned towards the container, is arranged to remain engaged, in a sealing manner, in said annular seat (12) of the coupling whilst being able to slide relative thereto, at the time of relative displacement of the bottle (16) and the container (1) necessary for perforation; said intermediate coupling having a shoulder, said neck of said container having a collar with a sealing skirt fixed to said neck, said collar having separation means including said membrane means held between said collar and said shoulder of said intermediate coupling and being clipped onto said collar.

2. Device according to claim 1, characterized in that the said peripheral skirt (25) is provided in the perforating assembly and presents an approximately U-shaped cross-section with its concave side opposite to the intermediate coupling (11), this skirt (25) making secure the joint between an external cylindrical sleeve (21) and an internal concentric sleeve (20) at the lower end of which is fixed a perforator (19) which is offset with regard to the assembly.

3. Device according to claim 2, characterized in that the internal sleeve (20) includes longitudinal openings (22) and, at its lower end, a projection (23) turned radially towards the exterior, constituting a lip, whereas the intermediate coupling (11) includes, on its internal wall, towards its upper end a projection (24) turned radially towards the interior similarly forming a kind of lip arranged to cooperate with said lip of the perforating assembly (18) to prevent an axial separation of the two elements.

4. Device according to claim 3 characterized in that the perforator (19) is constructed from a tubular element with a bevelled end arranged to open and fold back in a progressive manner the membrane (7, 7*a*) in a large a diameter as possible, during one rotation.

5. Device according to claim 1, characterized in that the bottle (16) is provided, at its end opposite the container, an applicator nozzle (28) and that a cap (29) is arranged to cover the bottle.

6. The device as claimed in claim 1, wherein said membrane means comprises a first and second membrane with said first membrane being sealed on said collar and said second membrane being sealed on said shoulder of said intermediate coupling, said first and second membranes being pressed one against the other when the assembly of the bottle and the container are in storage.

7. The device as claimed in claim 6, wherein said membranes are aluminum and one of said membranes includes a periphery which is non-varnished and which faces the bottle side with said periphery protected to avoid all chemical effects.

8. The device as claimed in claim 1, wherein said intermediate coupling includes an annular sleeve and said perforating assembly includes a fixing portion for clipping onto said annular sleeve.

* * * * *